US012607008B2

(12) United States Patent
Wiatrowski

(10) Patent No.: US 12,607,008 B2
(45) Date of Patent: Apr. 21, 2026

(54) JOINT EDGE INSERT

(71) Applicant: Illinois Tool Works Inc., Glenview, IL (US)

(72) Inventor: Darrell A. Wiatrowski, Libertyville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 344 days.

(21) Appl. No.: 18/192,399

(22) Filed: Mar. 29, 2023

(65) Prior Publication Data

US 2023/0323654 A1 Oct. 12, 2023

Related U.S. Application Data

(60) Provisional application No. 63/327,612, filed on Apr. 5, 2022.

(51) Int. Cl.
*E04B 1/68* (2006.01)

(52) U.S. Cl.
CPC ..... *E04B 1/68* (2013.01)

(58) Field of Classification Search
CPC . E04B 1/68; E04B 1/681; E01C 11/10; E01C 11/12; E04F 15/14; E01D 19/06; E02D 29/16
See application file for complete search history.

(56) References Cited

U.S. PATENT DOCUMENTS

| | | | | |
|---|---|---|---|---|
| 1,894,395 | A | 1/1933 | Burrell | |
| 2,064,528 | A | 12/1936 | Fischer | |
| 2,319,972 | A | 5/1943 | Brickman | |
| 3,527,009 | A | 9/1970 | Nyquist | |
| 4,021,984 | A | 5/1977 | Honegger | |
| 4,332,504 | A | 6/1982 | Arai | |
| 4,804,292 | A * | 2/1989 | DeLuca | E04B 1/6804 404/69 |
| 4,950,434 | A | 8/1990 | Ljungkvist et al. | |
| 5,261,635 | A | 11/1993 | Flathau | |
| 6,401,416 | B1 | 6/2002 | Ytterberg | |
| 6,775,952 | B2 * | 8/2004 | Boxall | E01C 11/14 404/74 |
| 7,547,158 | B1 | 6/2009 | Mucci | |
| 8,302,359 | B2 | 11/2012 | Boxall et al. | |
| D710,038 | S | 7/2014 | Keen | |
| 9,458,638 | B2 | 10/2016 | Parkes et al. | |
| 9,765,485 | B2 | 9/2017 | Keen | |
| 10,077,533 | B2 | 9/2018 | Meuwissen et al. | |
| 10,077,551 | B2 | 9/2018 | Parkes et al. | |

(Continued)

FOREIGN PATENT DOCUMENTS

| | | | |
|---|---|---|---|
| WO | WO-2013127812 A2 * | 9/2013 | E01C 11/08 |
| WO | 2021072038 A2 | 4/2021 | |

OTHER PUBLICATIONS

Great Britain Office Action from Great Britain Application No. 2304906.7, dated Oct. 17, 2023 (9 pages).

*Primary Examiner* — Patrick J Maestri
(74) *Attorney, Agent, or Firm* — Neal, Gerber & Eisenberg LLP

(57) ABSTRACT

A joint edge insert positionable in a gap between two joint edge members of a joint edge assembly attached to two adjacent concrete slabs, and configured to provide structural support for the joint in cooperation with the joint edge members to reduce joint spalling.

8 Claims, 9 Drawing Sheets

(56) References Cited

U.S. PATENT DOCUMENTS

| | | | | |
|---|---|---|---|---|
| 10,094,075 | B2 | 10/2018 | Keen | |
| 10,119,281 | B2 | 11/2018 | Connell | |
| 10,323,359 | B2 | 6/2019 | Meuwissen et al. | |
| 10,711,410 | B2 | 7/2020 | Meuwissen et al. | |
| 2008/0313989 | A1 | 12/2008 | Ireland | |
| 2014/0021185 | A1 | 1/2014 | Anagnostopoulos | |
| 2014/0242863 | A1* | 8/2014 | Voet | E01C 11/10 523/400 |
| 2014/0366472 | A1 | 12/2014 | Keen | |
| 2015/0016870 | A1 | 1/2015 | Arnold | |
| 2017/0009446 | A1 | 1/2017 | Eve | |
| 2017/0081805 | A1 | 3/2017 | Keen | |
| 2018/0371703 | A1 | 12/2018 | Meuwissen et al. | |
| 2019/0195137 | A1 | 6/2019 | Luschek et al. | |

* cited by examiner

JOINT EDGE INSERT

PRIORITY CLAIM

This application claims priority to and the benefit of U.S. Provisional Patent Application Ser. No. 63/327,612, filed Apr. 5, 2022, the entire contents of which are incorporated herein by reference.

BACKGROUND

Concrete floors often include a series of individual concrete slabs. The interface where one concrete slab meets an adjacent concrete slab is often called a joint. Freshly poured concrete shrinks considerably as it hardens due to the chemical reaction that occurs between the cement and water (i.e., hydration). As the concrete shrinks, tensile stress accumulates in the concrete. Therefore, the joints between adjacent concrete slabs need to be free to open and thus enable shrinkage of each of the individual concrete slabs without damaging the concrete floor.

These joint openings can create discontinuities in the concrete floor surface that can cause the wheels of a vehicle (such as a forklift truck) to impact the respective edges of the concrete slabs that form the joint and break pieces of concrete from the edge of each concrete slab, particularly if the joint edges are or become vertically mis-aligned. This damage to the edges of concrete slabs is often referred to as joint spalling. Joint spalling can interrupt the normal working operations of a facility by slowing down vehicle (such as forklift or truck) traffic and/or by causing damage to such vehicles or the products carried by such vehicles. Joint spalling can also be expensive and time consuming to repair.

While various joint edge assemblies and fillers have been employed to address joint spalling related issues as further discussed below, there is a continuing need to address these issues.

SUMMARY

Various embodiments of the present disclosure provide a joint edge insert in the gap between two adjacent concrete slabs or in the gap between two joint edge members of a joint edge assembly attached to two adjacent concrete slabs. In various embodiments, the joint edge insert of the present disclosure provides structural support for the joint in cooperation with the joint edge members to reduce joint spalling. In various embodiments, the joint edge insert includes an elongated waveform shaped, sized, and otherwise configured to be inserted in the gap between two spaced apart elongated joint edge members of a joint edge assembly and is configured to engage the opposing inner surfaces of such joint edge members to partially fill the gap between those members and to provide additional structural support in that gap.

Additional features and advantages of the present invention are described in, and will be apparent from, the following Detailed Description and the Figures.

DETAILED DESCRIPTION

Figure 1:
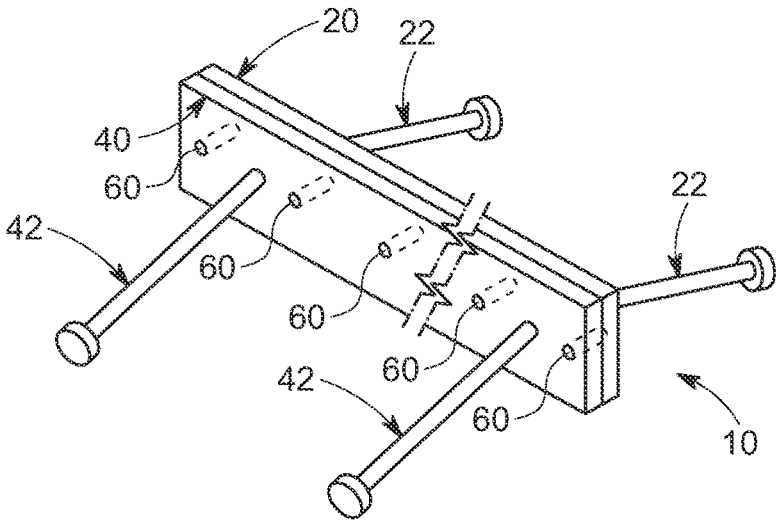
FIG. 1 (PRIOR ART)
FIG. 1 is a perspective view of a known joint edge assembly.

While the features, devices, and apparatus described herein may be embodied in various forms, the drawings show, and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, attached, connected, and the like, are not intended to be limited to direct mounting methods but should be interpreted broadly to include indirect and operably mounted, attached, connected and like mounting methods. This specification is intended to be taken as a whole and interpreted in accordance with the principles of the present disclosure and as understood by one of ordinary skill in the art.

Before describing example embodiments of the present disclosure in detail, it is helpful to explain certain joint edge assemblies and related issues for a better understanding of the present disclosure.

Joint edge assemblies that protect joints between concrete slabs are widely used in the construction of concrete floors (such as for construction joints for concrete floors in warehouses). Examples of known joint edge assemblies are described in U.S. Pat. Nos. 6,775,952 and 8,302,359. Various known joint edge assemblies enable the joint edges to self-open (with respect to the opposite joint edge) as the adjacent concrete slabs shrink during curing and hardening.

Figure 2:
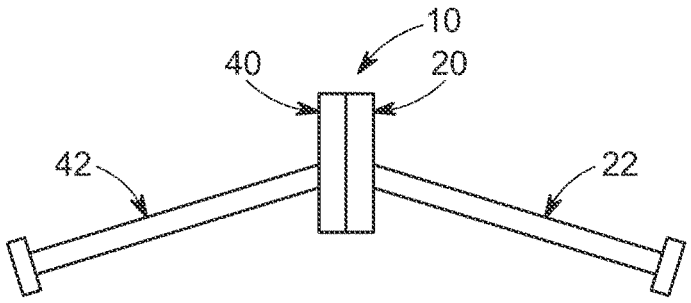
FIG. 2 (PRIOR ART)
FIG. 2 is an end view of the known joint edge assembly of FIG. 1.
Figure 3:
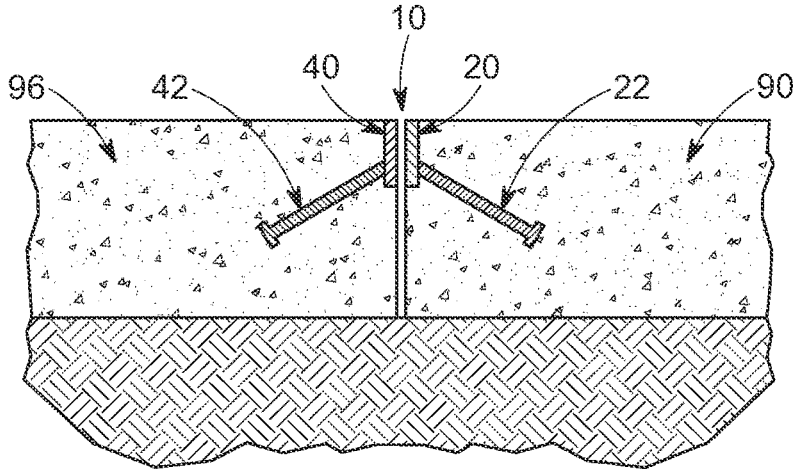
FIG. 3 (PRIOR ART)
FIG. 3 is a cross-sectional view of the known joint edge assembly of FIG. 1 shown mounted to two concrete slabs, and illustrating the separation of the two concrete slabs after they have shrunk to a certain extent.

One example known joint edge assembly 10 is generally illustrated in FIGS. 1, 2, 3, and 4. FIGS. 1 and 2 illustrate the joint edge assembly 10 prior to installation and before the concrete is poured. FIG. 3 illustrates the joint edge assembly 10 after installation and after the adjacent concrete slabs have started shrinking such that the elongated joint edge members 20 and 40 have separated to a certain extent. The two separate elongated extending joint edge members 20 and 40 are initially temporarily held together by a plurality of connectors 60. The connectors 60 connect the joint edge members 20 and 40 along their longitudinal lengths during installation. This known joint edge assembly 10 further includes a plurality of anchors 22 that extend from the joint edge member 20 into the region where the concrete of the first slab 90 is poured such that, upon hardening of the concrete slab 90, the anchors 22 are cast within the body of the concrete slab 90. This known joint edge assembly 10 also includes a plurality of anchors 42 that extend from the joint edge member 40 into the region where the concrete of the second slab 96 is poured such that, upon hardening of the concrete slab 96, the anchors 42 are cast within the body of the concrete slab 96. This known joint edge assembly 10 is positioned such that the inner end surfaces (not labeled) of the concrete slabs are aligned with the respective outer surfaces (not labeled) of the elongated joint edge members as best shown in FIG. 3.

Figure 4:
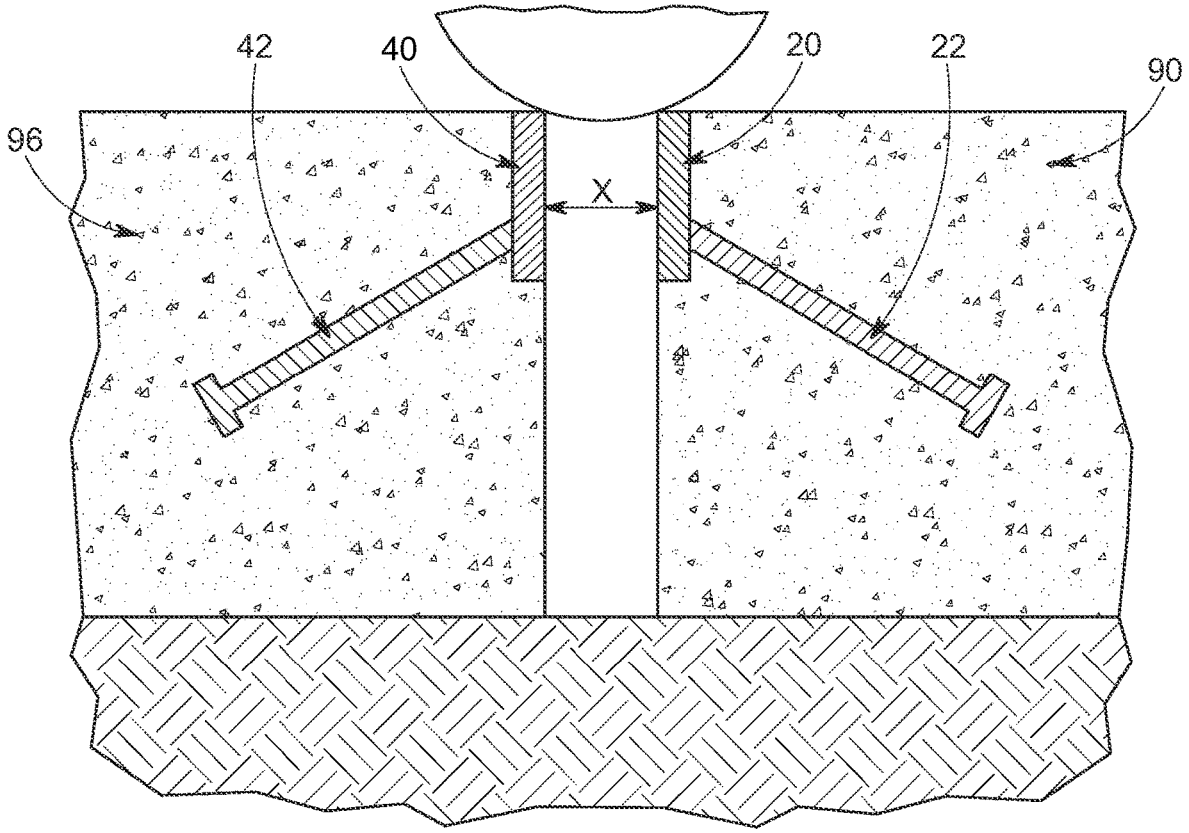
FIG. 4 (PRIOR ART)
FIG. 4 is a cross-sectional view of the known joint edge assembly of FIG. 1 shown mounted to two concrete slabs, and illustrating the further separation of the two concrete slabs after they have further shrunk to a greater extent than shown in FIG. 3.

One known problem with this type of known joint edge assembly is that the joint will open too much or too wide as generally shown in FIG. 4 such that the elongated joint edge members 20 and 40 have separated to a greater extent than that shown in FIG. 3. The distance X between the facing sides of the elongated joint edge members 20 and 40, which is the same distance between the facing sides of the concrete slabs 90 and 96 as shown in FIG. 4, can be up to approximately 25.4 millimeters (approximately 1.00 inch) in certain installations. Such wider joints can create various problems.

One problem with such wider joints is that as the joint becomes wider, the joint allows more engagement by the wheels of the vehicles that can damage the joint. More specifically, wheels (such as hard plastic or metal wheels found on product transportation devices such as but not limited to pallet trucks, ride-on pallet trucks, and autonomously guided vehicles) with smaller diameters can in some instances literally partially enter the joint and engage the edges and/or inside walls of the joint edge members 20 and 40. This impact can cause wear or damage to the wheels of the vehicles. These impacts can also loosen the engagements between the joint edge members 20 and 40 and the respective slabs 90 and 96. A series of these impacts can cause parts of the concrete slabs 90 or 96 under or behind the joint edge members 20 and 40 to break or crack, and possibly cause partial or complete disengagement of the joint edge members 20 or 40 from the respective slabs 90 or 96.

Another problem with such wider joints is that as the joint becomes wider, the joint enables more contaminants (such as water) to enter the joint, which can damage the joint. Elastomeric filler materials such as epoxy have been used to fill these joint openings. However, such materials do not provide structural support for such wheels in such joints.

Figure 5:
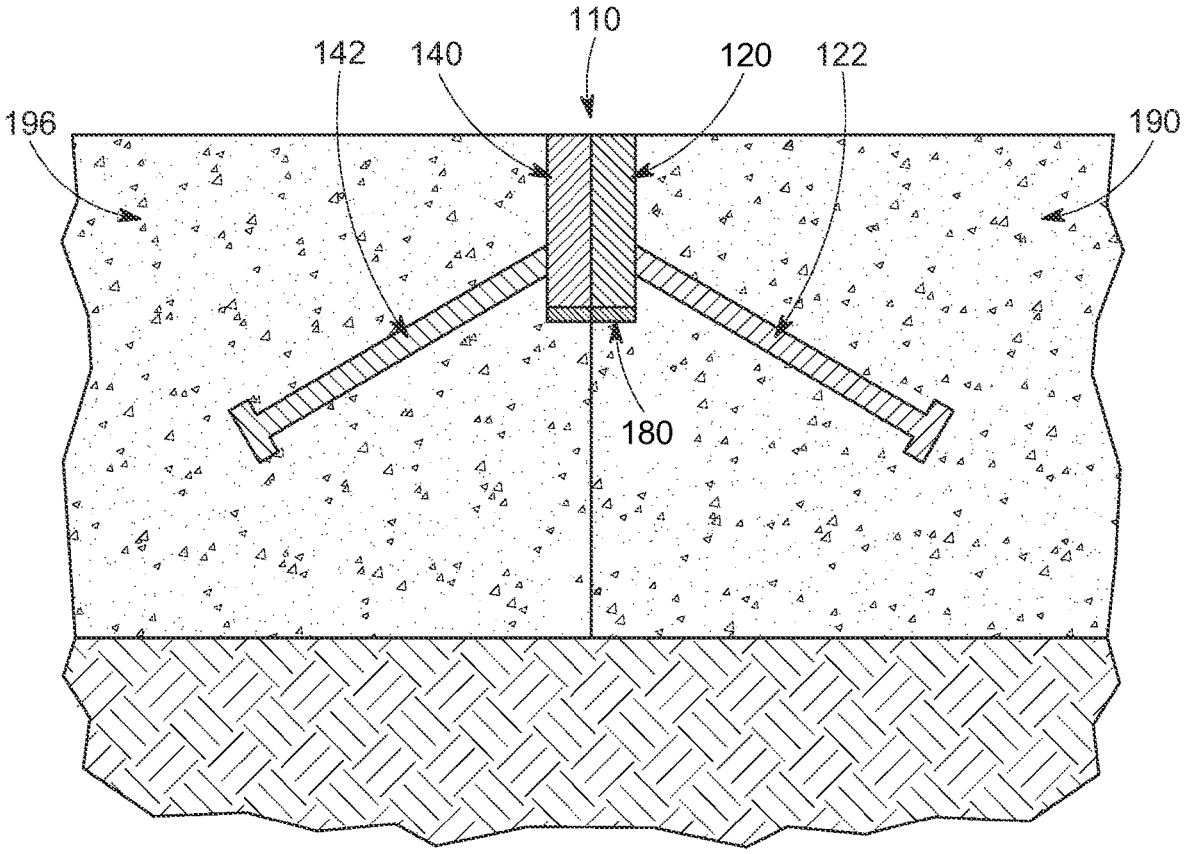
FIG. 5 (PRIOR ART)
FIG. 5 is a cross-sectional view of another known joint edge assembly shown mounted to two concrete slabs after installation and before the two concrete slabs have shrunk.
Figure 6:
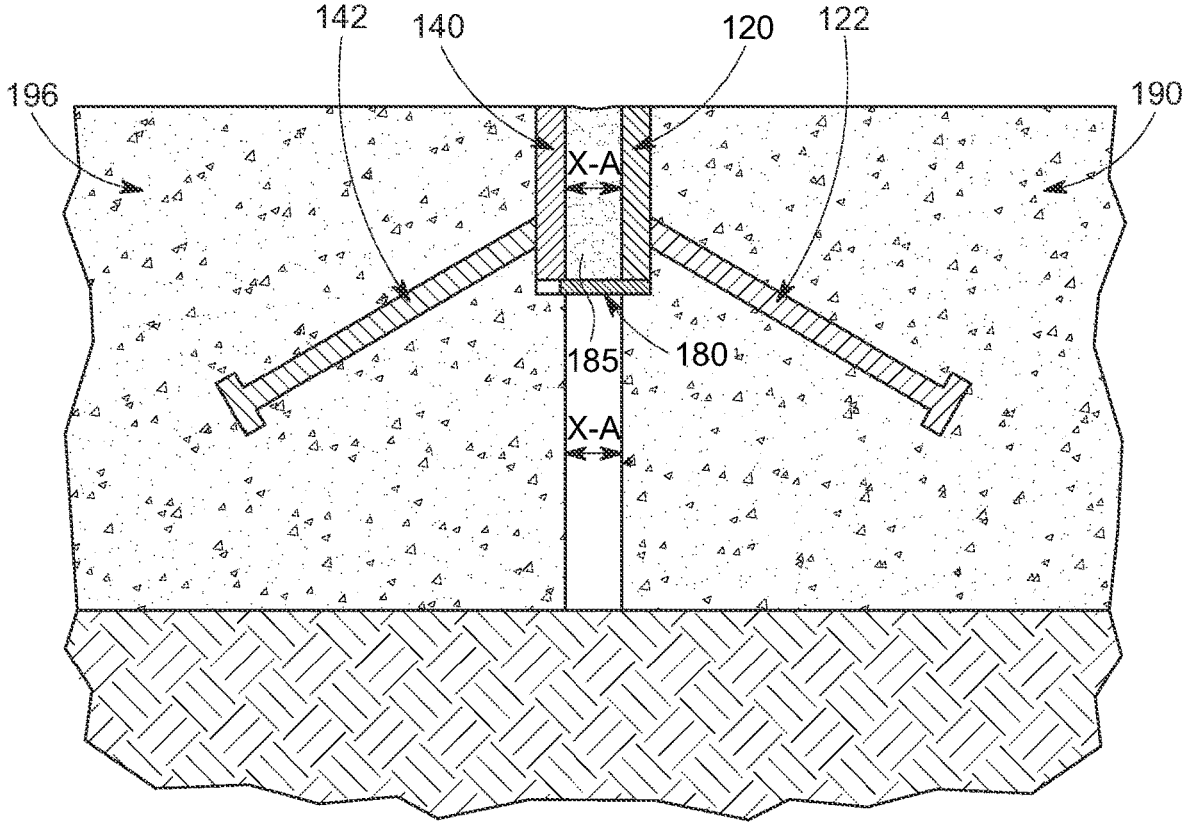
FIG. 6 (PRIOR ART)
FIG. 6 is a cross-sectional view of the known joint edge assembly of FIG. 5 shown mounted to two concrete slabs, and illustrates the separation of the two concrete slabs after they have shrunk to a certain extent.

Another known joint edge assembly 110 is generally illustrated in FIGS. 5 and 6 and includes two separate elongated joint edge members 120 and 140. Like the above joint edge assembly 10, this joint edge assembly 110 include a plurality of connectors (not shown) that connect the joint edge members 120 and 140 along their lengths during installation, and a plurality of anchors 122 and 142 that extend from the joint edge members 120 and 140 into the respective regions where the concrete of the slabs 190 and 196 are poured. This known joint edge assembly 110 also includes an elongated metal plate 180 that can be attached to the bottom edge of one of the joint edge members such as joint edge member 120. This metal plate 180 is positioned to prevent the filler material above the plate from leaking into the portion of the joint below the metal plate 180. FIG. 5 illustrates the joint edge assembly 110 after installation and immediately after the concrete is poured. FIG. 6 illustrates the joint edge assembly 110 after installation and after the concrete has started shrinking such that the elongated joint edge members 120 and 140 have separated and such that the distance between the facing sides of the elongated joint edge members 120 and 140 is X-A. In various installations, X-A is approximately 9.525 millimeters (approximately 0.375 inches). As shown in FIG. 6, the metal plate 180 prevents the filler material above plate from leaking into the portion of the joint below the metal plate 180. This elongated metal plate 180 helps to address joint spalling and filler issues but does not solve these issues.

More specifically, one issue with an epoxy filled joint is that the joint, after filled with the epoxy, cannot expand or contract with temperature changes without potentially damaging the epoxy filler and thus the joint. Another issue with an epoxy filled joint is that the epoxy joint filler must often be repaired due to wear. Another issue with an epoxy filled joint is that if the concrete continues to shrink after the epoxy is installed the epoxy can pull away from joint walls and become loose, requiring premature replacement.

The present disclosure addresses these issues by providing an elongated joint edge insert that is insertable in the gap in a joint between adjacent concrete slabs and specifically between the elongated joint edge members of a joint edge assembly. The elongated joint edge insert provides structural support for the joint such as but not limited to the joints described above. The elongated joint edge insert of various embodiments of the present disclosure can be used alone or with an epoxy filler or another suitable filler.

Figure 7:
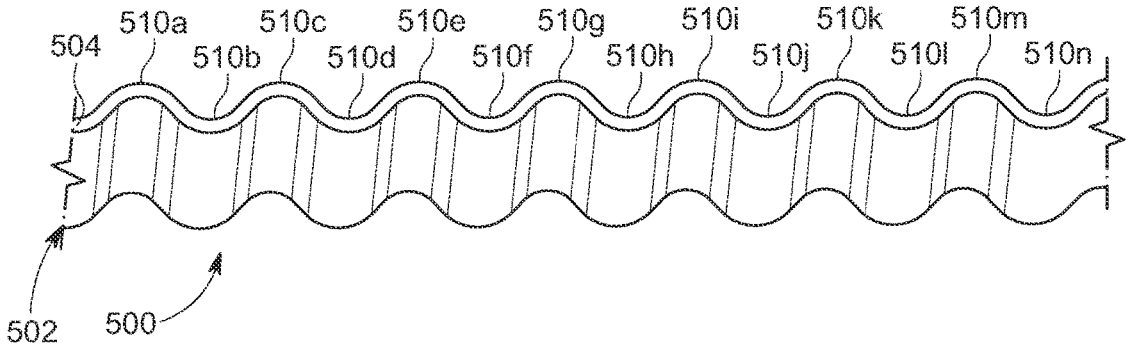
FIG. 7 is a top fragmentary perspective view of a portion of a joint edge insert of one example embodiment of the present disclosure.
Figure 8:
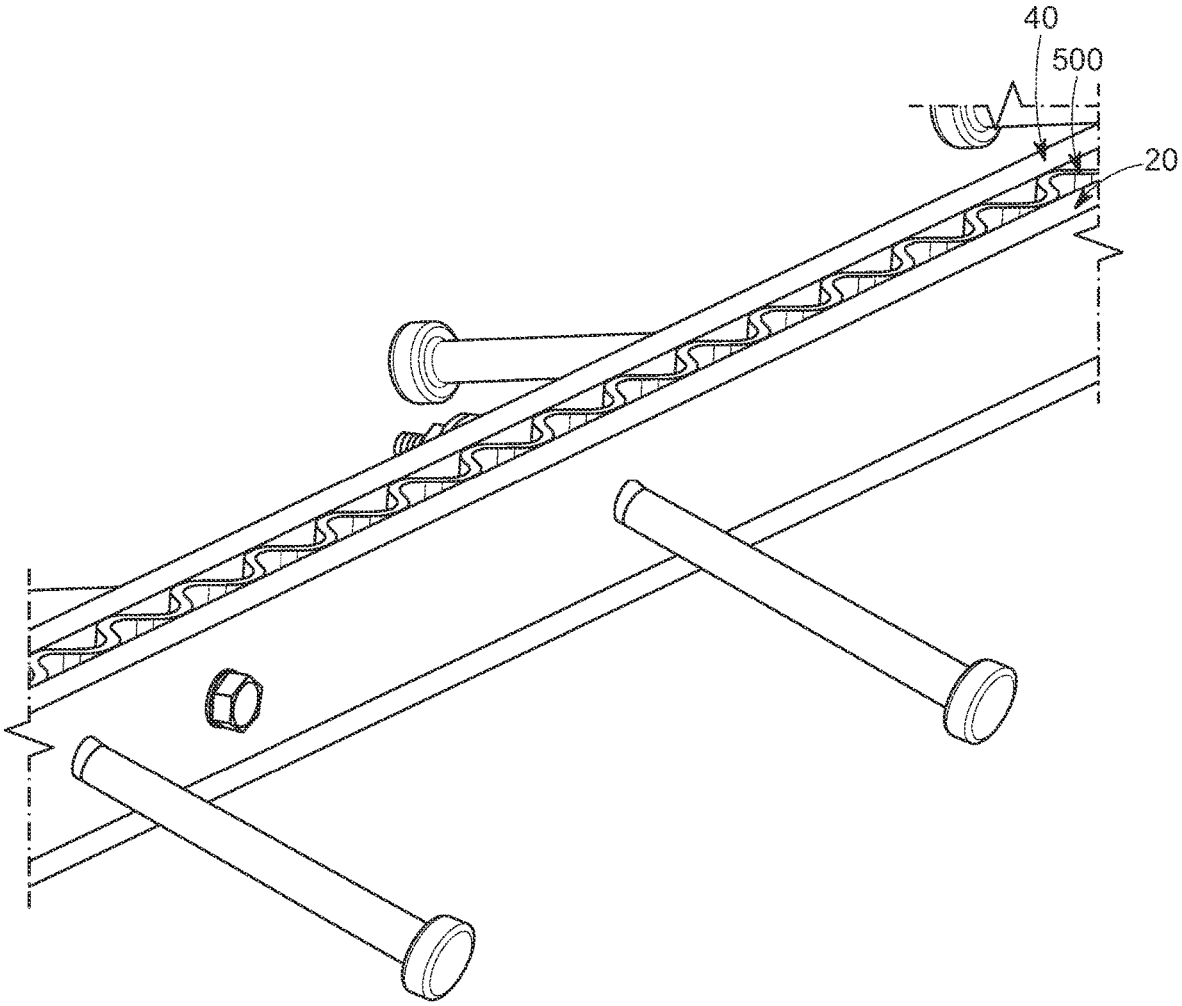
FIG. 8 is a top fragmentary perspective view of a portion of the joint edge insert of FIG. 7 positioned in the known joint edge assembly of FIG. 5 after the two concrete slabs have shrunk.

Referring now to FIGS. 7 and 8, one example embodiment of a joint edge insert of the present disclosure is partially shown and generally indicated by numeral 500. The joint edge insert 500 generally includes an elongated waveform 502 shaped, sized, and otherwise configured to be inserted between two spaced apart elongated joint edge members such as joint edge members 20 and 40 described above and configured to engage the opposing inner surfaces (not labeled) of such joint edge members 20 and 40 such as shown in FIG. 8. The joint edge insert 500 provides structural support for this joint in cooperation with the joint edge members 20 and 40.

The waveform 502 includes a vertically extending upstanding wall 504 having a plurality of sections. FIG. 7 shows a portion of the waveform 502 including sections 510*a*, 510*b*, 510*c*, 510*d*, 510*e*, 510*f*, 510*g*, 510*h*, 510*i*, 510*j*, 510*k*, 510*l*, 510*m*, and 510*n*. The sections 510*a* to 510*n* include a plurality of first peaks (not individually labeled) extending in first direction and that function as first member engagers configured to engage the inner surface of the first member 20 of the joint edge assembly, and a plurality of second peaks (not labeled) extending in an opposite second direction and that function as second member engagers configured to engage inner surface of the second member 40 of the joint edge assembly. The first and second peaks thus point in opposite directions and have respective outmost surfaces that extend in spaced apart vertical planes. The waveform 502 also has a longitudinally extending central axis (not shown or labeled). The waveform 502 is rigid and generally not compressible in the vertical direction (from top to bottom), is flexible in the longitudinal direction (from end to end), and is partially flexible (or partially rigid) in the transverse direction (from side to side or peak to peak). In various embodiments, the waveform 502 is or can be slightly compressed in the transverse direction when inserted between the members 20 and 40 of the joint edge assembly.

This joint edge insert can be used alone or with epoxy filler or another filler. The waveform 502 and specifically the plurality of sections such as sections 510*a* to 510*n* also define: (1) first filler material receipt pockets (not labeled) that extend outwardly in a first direction from the longitudinal central axis; and (2) second filler material receipt pockets (not labeled) that extend outwardly in an opposite second direction from the longitudinal central axis. Each of the plurality of filler material receipt pockets are wider at their openings and narrower at their innermost points, and are inwardly tapered from their openings to their innermost points.

In this example embodiment, the sections 510*a* to 510*n* of the waveform 502 have the same radius of curvature. In this example embodiment, the sections 510*a* to 1510*n* have the same radius of curvature such that: (1) all of the first peaks (or outer surfaces thereof) extend in the same first vertical plane; and (2) all of the second peaks (or outer surfaces thereof) extend in the same second vertical plane. As further discussed below, the radius of curvatures of two or more of the sections can vary in accordance with the present disclosure. The curvatures can be considered to at least partially define the amplitude of the waveform 502. The amplitude of the waveform 502 can vary in accordance with the present disclosure. The waveform can also have a varying amplitude in accordance with the present disclosure as discussed below.

The joint edge insert 500 is configured to be positioned between the elongated edge members of a joint edge assembly for adjacent concrete slabs such that the first member engagers engage the first member 20 as shown in FIG. 8 and such that the second member engagers engage the second member such as member 40. The joint edge insert 500 therefore partially fills the gap between the separated joint edge member with a vertically rigid support. It should be appreciated that the joint edge insert can alternatively be employed with an appropriate filler such as an epoxy filler. The waveform 502 is configured to cause a natural bias against the respective inner surfaces of the first and second joint edge members 20 and 40. The waveform 502 can be compressed in the transverse direction if the concrete slabs and thus the joint edge members 20 and 40 move toward each other. The waveform 502 is configured to not be damaged if the concrete slabs and thus the joint edge members 20 and 40 move away from each other in the transverse direction.

The quantity of sections of the waveform 502 can also vary in accordance with the present disclosure, such as based on the length of the joint edge assembly. In this example embodiment, the joint edge insert 500 is as long as the elongated members 20 and 40. The joint edge insert 500 can be made in other suitable lengths, widths, sizes, shapes, and configurations in accordance with the present disclosure. The joint edge insert 500 can be made in shorter lengths so that two or more joint edge inserts 500 are used between the members of the joint edge assembly. In various embodiments, the waveform 502 or parts thereof can vary in amplitude or frequency.

The joint edge insert 500 is made from steel in this example embodiment. The joint edge insert 500 can be made from other suitable materials in accordance with the present disclosure. In this illustrated example embodiment, this joint edge insert 500 is a single monolithically formed piece. In other embodiments, the joint edge insert 500 or parts thereof can be separately formed and connected together.

Figure 9:
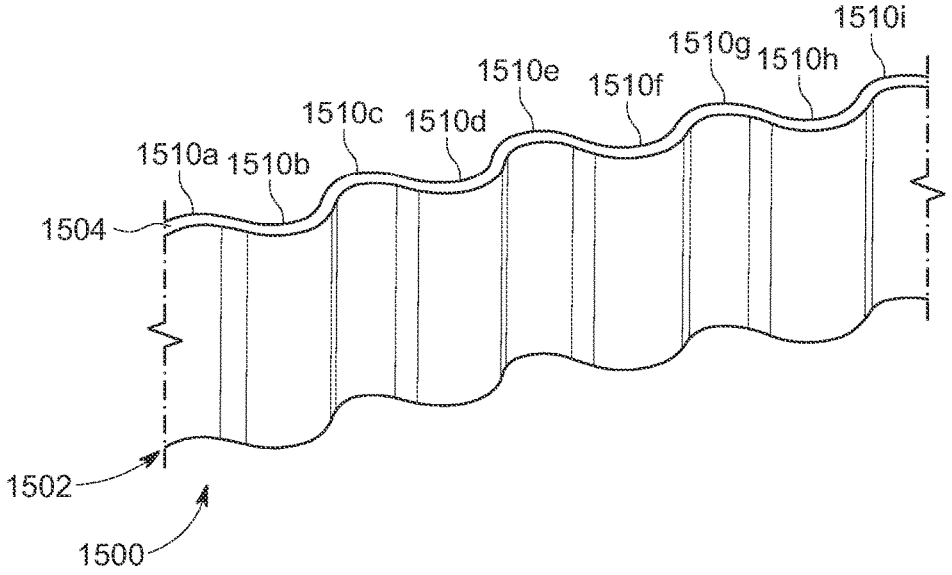
FIG. 9 is a top fragmentary perspective view of a portion of a joint edge insert of another example embodiment of the present disclosure.
Figure 10:
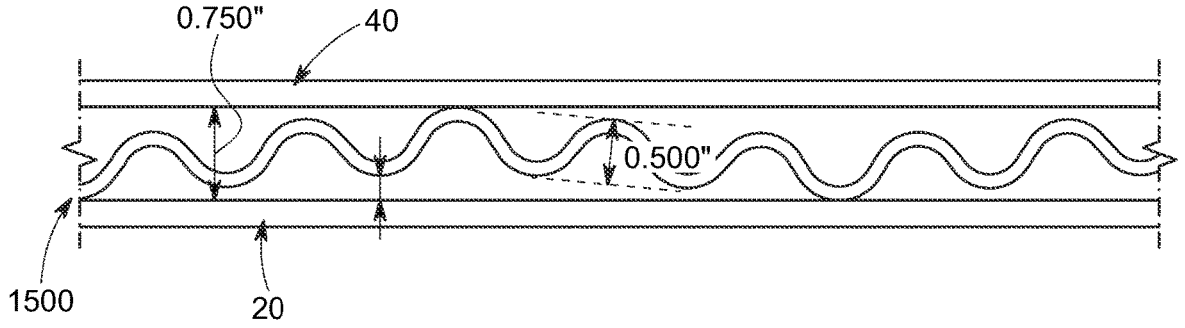
FIG. 10 is a top fragmentary view of the portion of the joint edge insert of FIG. 9 positioned in the known joint edge assembly of FIG. 5 after the two concrete slabs have shrunk.
Figure 11:
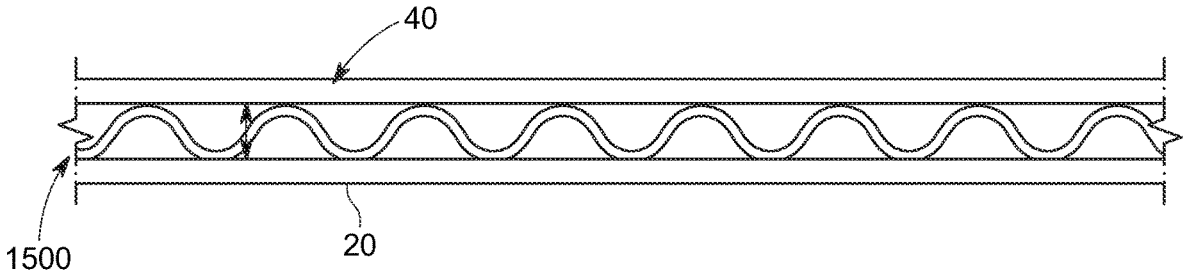
FIG. 11 is a top fragmentary view of the portion of the joint edge insert of FIG. 9 positioned in the known joint edge assembly of FIG. 5 after the two concrete slabs have shrunk and then moved closer together.

Referring now to FIGS. 9, 10, and 11, another example embodiment of a joint edge insert of the present disclosure is partially shown and generally indicated by numeral 1500. The joint edge insert 1500 generally includes an elongated waveform 1502 shaped, sized, and otherwise configured to be inserted between two spaced apart elongated joint edge members such as joint edge members 20 and 40 described above and configured to engage the opposing inner surfaces of such joint edge members 20 and 40 such as shown in FIGS. 10 and 11. The joint edge insert 1500 provides structural support for this joint in cooperation with the joint edge members 20 and 40.

The waveform 1502 includes a vertically extending upstanding wall 1504 having a plurality of sections. FIG. 9 shows a portion of such a waveform 1502 having a plurality of sections such as sections 1510*a*, 1510*b*, 1510*c*, 1510*d*, 1510*e*, 1510*f*, 1510*g*, 1510*h*, 1510*i*, and 1510*j*. The sections 1510*a* to 1510*j* include a plurality of first peaks (not labeled) that extend in a first direction and that function as first member engagers configured to engage the first member such as member 20, and a plurality of second peaks (not labeled) that extend in an opposite second direction and that function as second member engagers configured to engage the second member such as member 40. The waveform 1502 also has a longitudinally extending central axis (not labeled). The waveform 1502 is rigid and generally not compressible in the vertical direction (from top to bottom), is flexible in the longitudinal direction (from end to end), and is partially flexible (or partially rigid) in the transverse direction (from side to side or peak to peak). In various embodiments, the waveform 1502 is slightly compressed in the transverse direction when inserted between the members 20 and 40 of the joint edge assembly.

The waveform 1502 and specifically the plurality of sections also define: (1) filler material receipt pockets 1525*a*, 1525*b*, 1525*c*, 1525*d*, 1525*e*, 1525*f*, 1525*g*, and

1530*h* that extend outwardly in a first direction from the longitudinal central axis; and (2) filler material receipt pockets 1545*a*, 1545*b*, 1545*c*, 1545*d*, 1545*e*, 1545*f*, 1545*g*, and 1530*h*, that extend outwardly in an opposite second direction from the longitudinal central axis. Each of the plurality of filler material receipt pockets are wider at their openings and narrower at their innermost points, and are inwardly tapered from their openings to their innermost points.

In this example embodiment, the sections 1510*a* to 1510*j* have the same radius of curvature, but waveform 1502 is bent at spaced apart surfaces such that: (1) all of the first peaks (or outer surfaces thereof) do not extend in the same first vertical plane (i.e., one or more of the first peaks extend transversely wider than one or more of the other first peaks); and (2) all of the second peaks (or outer surfaces thereof) do not extend in the same second vertical plane (i.e., one or more of the second peaks extend transversely wider than one or more of the other second peaks). In other embodiments, the waveform has different radiuses of curvatures such that: (1) all of the first peaks do not extend in the same first vertical plane (i.e., one or more of the first peaks extend transversely wider than one or more of the other first peaks); and (2) all of the second peaks do not extend in the same second vertical plane (i.e., one or more of the second peaks extend transversely wider than one or more of the other second peaks). In various embodiments, the waveform 1502 can thus have a compound amplitude.

The quantity of sections of the waveform 1502 can also vary in accordance with the present disclosure, such as based on the length of the joint edge assembly. In this example embodiment, the joint edge insert 1500 is as long as the elongated members 20 and 40. The joint edge insert 1500 can be made in other suitable lengths, widths, sizes, shapes, and configurations in accordance with the present disclosure. The joint edge insert 1500 can be made in shorter lengths so that two or more joint edge inserts 1500 are used between the members of the joint edge assembly. In various embodiments, the waveform 1502 or parts thereof can vary in amplitude or frequency.

The joint edge insert 1500 is made from steel in this example embodiment. The joint edge insert 1500 can be made from other suitable materials in accordance with the present disclosure. In this illustrated example embodiment, this joint edge insert 1500 is a single monolithically formed piece. In other embodiments, the joint edge insert 1500 or parts thereof can be separately formed and connected together.

The joint edge insert 1500 is configured to be positioned between the elongated members of a joint for adjacent concrete slabs such that the first member engagers engage the first member 20 as shown in FIGS. 10 and 11 and such that the second member engagers engage the second member such as member 40. The waveform 1502 is configured to cause a natural bias against the respective inner surfaces of the first and second joint edge members 20 and 40. The waveform 1502 can be compressed in the transverse direction if the concrete slabs and thus the joint edge members 20 and 40 move toward each other. The waveform 1502 will not need be damaged if the concrete slabs and thus the joint edge members 20 and 40 move away from each other in the transverse direction.

The joint edge insert 500 therefore partially fills the gap between the separated joint edge members without another filler. It should be appreciated that the joint edge insert can alternatively be employed with an appropriate filler such as an epoxy filler.

Figure 12:
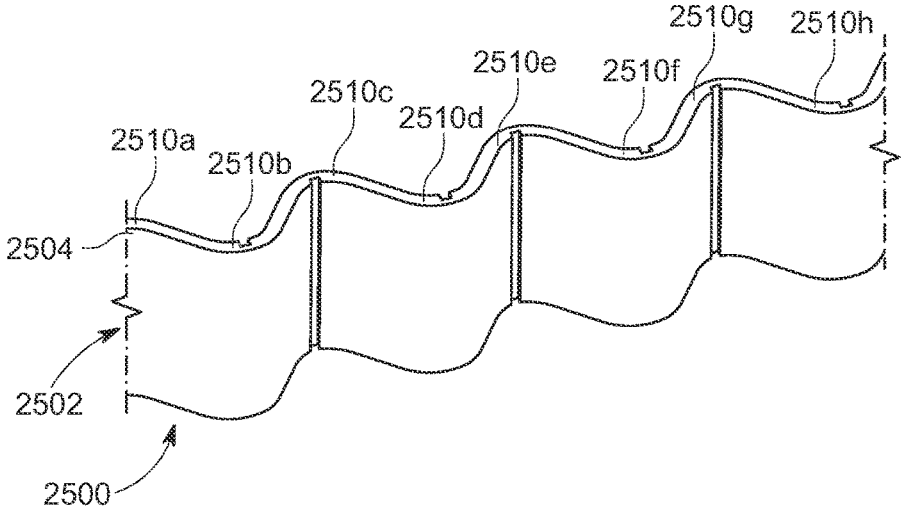
FIG. 12 is a top fragmentary perspective view of a portion of a joint edge insert of another example embodiment of the present disclosure.
Figure 13:
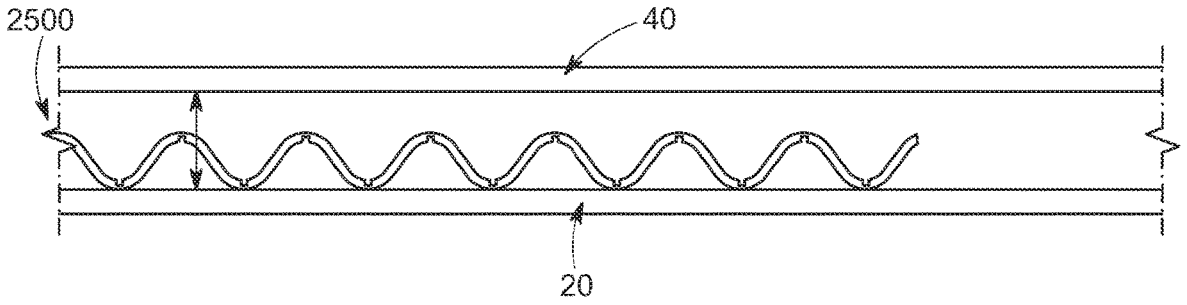
FIG. 13 is a top fragmentary view of the portion of the joint edge insert of FIG. 12 positioned in the known joint edge assembly of FIG. 5 after the two concrete slabs have shrunk.
Figure 14:
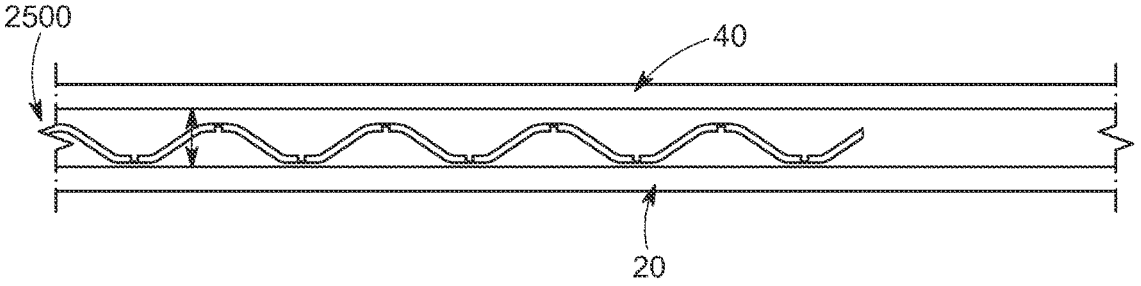
FIG. 14 is a top fragmentary view of the portion of the joint edge insert of FIG. 12 positioned in the known joint edge assembly of FIG. 5 after the two concrete slabs have shrunk and then moved closer together.

Referring now to FIGS. 12, 13, and 14, another example embodiment of the joint edge insert of the present disclosure is generally indicated by numeral 2500. The joint edge insert 2500 generally includes an elongated waveform 2502 shaped, sized, and otherwise configured to be inserted between two spaced apart elongated joint edge members such as joint edge members 20 and 40 described above and configured to engage the opposing inner surfaces of such joint edge members 20 and 40 such as shown in FIGS. 13 and 14. The joint edge insert 2500 provides structural support for this joint in cooperation with the joint edge members 20 and 40.

The waveform 2502 includes a vertically extending upstanding wall 2504 having a plurality of sections. FIG. 12 shows a portion of such a waveform 2502 having sections 2510*a*, 2510*b*, 2510*c*, 2510*d*, 2510*e*, 2510*f*, 2510*g*, and 2510*h*. The sections include a plurality of first peaks (not labeled) that extend in a first direction and that function as first member engagers configured to engage the first member such as member 20, and a plurality of second peaks (not labeled) that extend in an opposite second direction and that function as second member engagers configured to engage the second member such as member 40. The waveform 2510 also has a longitudinally extending central axis (not labeled). Each of the sections 2510*a* to 2510*h* each defines a vertically extending weakened area such as a vertically extending notch (not labeled) that facilitates the bending in the waveform 2502 in the transverse direction (from side to side or peak to peak) without practically affecting the structural support provided by the waveform 2502. The waveform 2502 is rigid and generally not compressible in the vertical direction (from top to bottom), is flexible in the longitudinal direction (from end to end), and is partially flexible (or partially rigid) in the transverse direction (from side to side or peak to peak). In various embodiments, the waveform 2502 is slightly compressed in the transverse direction when inserted between the members 20 and 40 of the joint edge assembly.

The waveform 2502 and specifically the plurality of sections also define: (1) filler material receipt pockets (not labeled) that extend outwardly in a first direction from the longitudinal central axis; and (2) filler material receipt pockets (not labeled) that extend outwardly in an opposite second direction from the longitudinal central axis. Each of the plurality of filler material receipt pockets are wider at their openings and narrower at their innermost points, and are inwardly tapered from their openings to their innermost points.

In this example embodiment with the weakened areas, the sections 2510*a* to 2510*h* have the same radius of curvature such that: (1) all of the first peaks (or outer surfaces thereof) extend in the same first vertical plane; and (2) all of the second peaks (or outer surfaces thereof) extend in the same second vertical plane. In other example embodiments with the weakened areas, the sections can have different radiuses of curvature such that: (1) not all of the first peaks (or outer surfaces thereof) extend in the same vertical planes; and (2) not all of the second peaks (or outer surfaces thereof) extend in the same second vertical planes.

As shown in FIG. 14, the vertical weakened areas such as the vertical notches enable the first and second vertical planes to move closer to each other when the members 20 and 40 move closer to each other.

The quantity of sections of the waveform 2502 can also vary in accordance with the present disclosure, such as based on the length of the joint edge assembly. In this example embodiment, the joint edge insert 2500 is as long as the elongated members 20 and 40. The joint edge insert 2500 can be made in other suitable lengths, widths, sizes, shapes, and configurations in accordance with the present disclosure. The joint edge insert 2500 can be made in shorter lengths so that two or more joint edge 2500 inserts are used between the members of the joint edge assembly. In various embodiments, the waveform 2502 or parts thereof can vary in amplitude or frequency.

The joint edge insert 2500 is made from steel in this example embodiment. The joint edge insert 2500 can be made from other suitable materials in accordance with the present disclosure. In this illustrated example embodiment, this joint edge insert 2500 is a single monolithically formed piece. In other embodiments, the joint edge insert 2500 or parts thereof can be separately formed and connected together.

The joint edge insert 2500 is configured to be positioned between the elongated members of a joint for adjacent concrete slabs such that the first member engagers engage the first member 20 as shown in FIGS. 13 and 14 and such that the second member engagers engage the second member such as member 40.

The joint edge insert 2500 therefore partially fills the gap between the separated joint edge members without another filler. It should be appreciated that the joint edge insert 2500 can alternatively be employed with an appropriate filler such as an epoxy filler.

Figure 15:
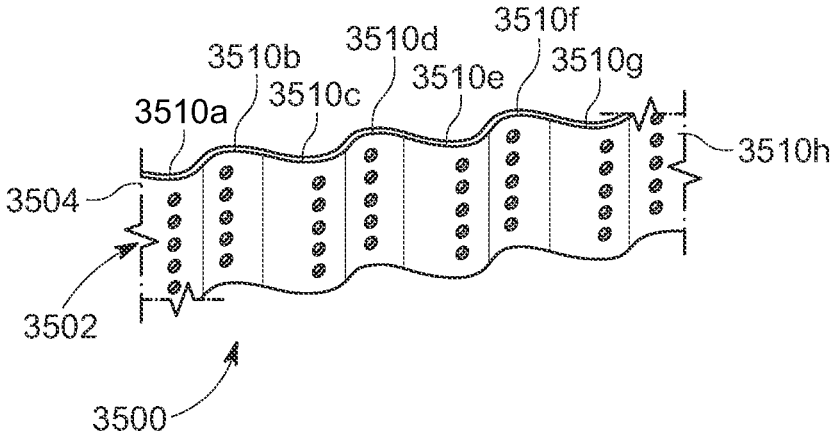
FIG. 15 is a top fragmentary perspective view of a portion of a joint edge insert of another example embodiment of the present disclosure.

Referring now to FIG. 15 another example embodiment of the joint edge insert of the present disclosure with weakened sections is generally indicated by numeral 3500. The joint edge insert 3500 generally includes an elongated waveform 3502 shaped, sized, and otherwise configured to be inserted between two spaced apart elongated joint edge members such as joint edge members 20 and 40 described above and configured to engage the opposing inner surfaces of such joint edge members 20 and 40. The joint edge insert 3500 provides structural support for this joint in cooperation with the joint edge members 20 and 40.

The waveform 3502 includes a vertically extending upstanding wall 3504 having a plurality of sections. FIG. 15 shows a portion of such a waveform 3502 having sections 3510*a*, 3510*b*, 3510*c*, 3510*d*, 3510*e*, 3510*f*, 3510*g*, and 3510*h*. The sections include a plurality of first peaks (not labeled) that extend in a first direction and that function as first member engagers configured to engage the first member such as member 20, and a plurality of second peaks (not labeled) that extend in an opposite second direction and that function as second member engagers configured to engage the second member such as member 40. The waveform 3510 also has a longitudinally extending central axis (not labeled). Each of the sections 3510*a* to 3510*h* each defines a series of vertically spaced-part openings (not labeled) that facilitate the bending in the waveform 3502 in the transverse direction (from side to side or peak to peak) with practically affecting the structural support provided by the waveform 3502. The waveform 3502 is rigid and generally not compressible in the vertical direction (from top to bottom), is flexible in the longitudinal direction (from end to end), and is partially flexible (or partially rigid) in the transverse direction (from side to side or peak to peak). In various embodiments, the waveform 3502 is or can be slightly compressed in the transverse direction when inserted between the members 20 and 40 of the joint edge assembly.

The waveform 3502 and specifically the plurality of sections also define: (1) filler material receipt pockets (not labeled) that extend outwardly in a first direction from the longitudinal central axis; and (2) filler material receipt pockets (not labeled) that extend outwardly in an opposite second direction from the longitudinal central axis. Each of the plurality of filler material receipt pockets are wider at their openings and narrower at their innermost points, and are inwardly tapered from their openings to their innermost points.

In this example embodiment with the weakened sections, the sections 3510*a* to 3510*h* have the same radius of curvature such that: (1) all of the first peaks extend in the same first vertical plane; and (2) all of the second peaks extend in the same second vertical plane. In other example embodiments with the weakened areas, the sections have can have different radiuses of curvature such that: (1) not all of the first peaks (or outer surfaces thereof) extend in the same vertical planes; and (2) not all of the second peaks (or outer surfaces thereof) extend in the same second vertical planes.

The weakened areas and specifically the sets of vertical spaced apart openings enable the first and second vertical planes to move closer to each other when the members 20 and 40 move closer to each other and thus when the waveform 3502 is under compression.

The quantity of sections of the waveform 3502 can also vary in accordance with the present disclosure, such as based on the length of the joint edge assembly. In this example embodiment, the joint edge insert 3500 is as long as the elongated members 20 and 40. The joint edge insert 3500 can be made in other suitable lengths, widths, sizes, shapes, and configurations in accordance with the present disclosure. The joint edge insert 3500 can be made in shorter lengths so that two or more joint edge inserts 3500 are used between the members of the joint edge assembly. In various embodiments, the waveform 3502 or parts thereof can vary in amplitude or frequency.

The joint edge insert 3500 is made from steel in this example embodiment. The joint edge insert 3500 can be made from other suitable materials in accordance with the present disclosure. In this illustrated example embodiment, this joint edge insert 3500 is a single monolithically formed piece. In other embodiments, the joint edge insert 3500 or parts thereof can be separately formed and connected together.

The joint edge insert 3500 is configured to be positioned between the elongated members of a joint for adjacent concrete slabs such that the first member engagers engage the first member 20 and such that the second member engagers engage the second member such as member 40.

The joint edge insert 3500 therefore partially fills the gap between the separated joint edge members without another filler. It should be appreciated that the joint edge insert 3500 can alternatively be employed with an appropriate filler such as an epoxy filler.

In various alternatives of the embodiments described above, the shape of the waves of the waveforms can vary. For example, the waveforms or parts thereof can have triangular waves or sections, trapezoidal waves or section, or other suitably shaped waves or sections.

Figure 19:
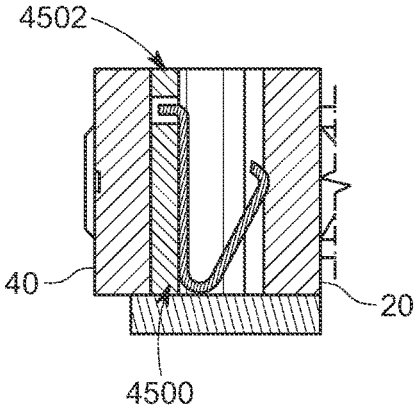
FIG. 19 is a fragmentary end view of the joint edge insert of FIG. 16 positioned in the known joint edge assembly of FIG. 5 after the two concrete slabs have shrunk.

Referring now to FIGS. 16, 17, 18, and 19, another example embodiment of the joint edge insert of the present disclosure is generally indicated by numeral 4500. The joint edge insert 4500 generally includes an elongated waveform 4502 and a plurality of engagement clips 4600 attached to the waveform 4502 and shaped, sized, and otherwise configured to be inserted between two spaced apart elongated joint edge members such as joint edge members 20 and 40 described above and configured to engage the opposing inner surfaces of such joint edge members 20 and 40 such as shown in FIG. 19.

Figure 16:
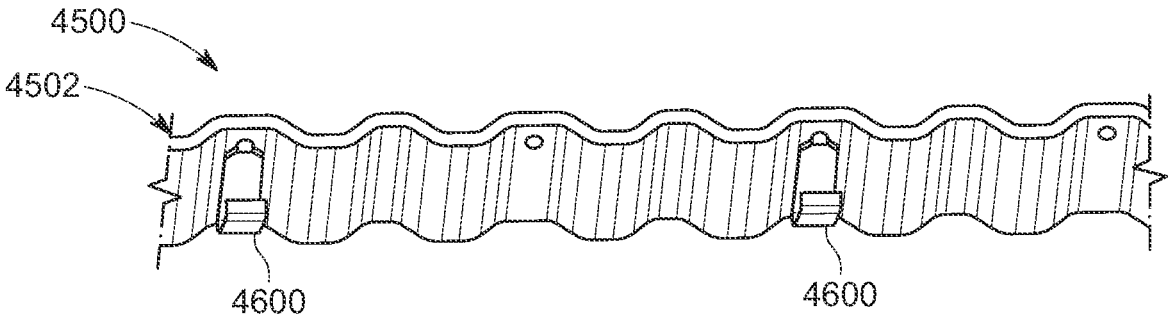
FIG. 16 is a top fragmentary perspective view of a portion joint edge insert of another example embodiment of the present disclosure.
Figure 17:
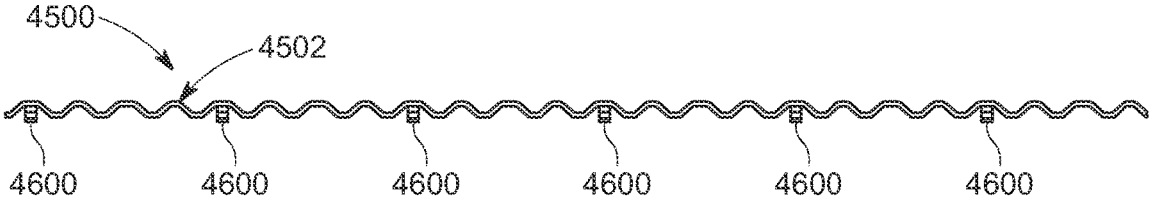
FIG. 17 is a top fragmentary view of the portion of the joint edge insert of FIG. 16.
Figure 18:
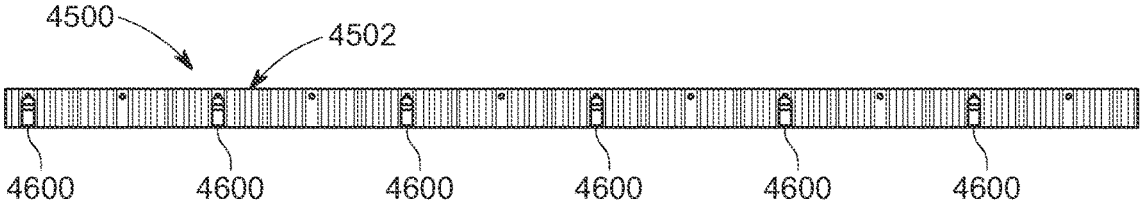
FIG. 18 is a side fragmentary view of the portion of the joint edge insert of FIG. 16.

The waveform 4502 includes a vertically extending upstanding wall (not labeled) having a plurality of sections (not labeled). FIG. 16 shows a portion of such a waveform 4502. The sections include a plurality of first peaks (not labeled) that function as first member engagers configured to engage one of the members such as the second member such as member 40. The plurality of engagement clips 4600 include a plurality of arms that function as second member engagers configured to engage the other member such as member 20 in this example embodiment. The waveform 4502 is rigid and generally not compressible in the vertical direction (from top to bottom), is flexible in the longitudinal direction (from end to end), and is rigid in the transverse direction (from side to side or peak to peak). The plurality of clips engagement clips 4600 provide the partial flexibility of the joint edge insert 4500 in the transverse direction. In various embodiments, the engagement clips 6000 are or can be slightly compressed in the transverse direction when inserted between the members 20 and 40 of the joint edge assembly.

In this example embodiment, the waveform 4502 is generally not configured to be used with a filler material because the filler material can interfere with the operation of the plurality of engagement clips 4600. In this example embodiment, the waveform 4502 includes a plurality of longitudinally spaced-apart openings (not labeled) that are configured for facilitating attachment of the plurality of engagement clips 4600. In other embodiments, the engagement clips can be connected to the waveform 4502 via other suitable methods such as via welding.

In this example embodiment, the sections of the waveform 4502 are formed from combinations of generally straight sub-sections that are not curved or radiused, however such sections sub-sections could alternatively be curved or radiused. In various embodiments, the waveform 4502 or parts thereof can vary in amplitude or frequency.

The quantity of sections of the waveform 4502 can also vary in accordance with the present disclosure, such as based on the length of the joint edge assembly. In this example embodiment, the joint edge insert 4500 is as long as the elongated members 20 and 40. The joint edge insert 4500 can be made in other suitable lengths, widths, sizes, shapes, and configurations in accordance with the present disclosure. The joint edge insert 4500 can be made in shorter lengths so that two or more joint edge inserts 4500 are used between the members of the joint edge assembly.

The joint edge insert 4500 (including the waveform 4502 and the engagement clips 4600) is made from steel in this example embodiment. The joint edge insert 4500 can be made from other suitable materials in accordance with the present disclosure. In this illustrated example embodiment, this waveform 4502 of the joint edge insert 4500 is a single monolithically formed piece. In other embodiments, the joint edge insert 4500 or parts thereof can be separately formed and connected together.

The joint edge insert 4500 is configured to be positioned between the elongated members of a joint for adjacent concrete slabs such that the first member engagers engage the first member 20 as shown in FIG. 19 and such that the waveform 4502 engages the second member such as member 40 and the clips engage member 20. The joint edge insert 4500 therefore partially fills the gap between the separated joint edge members without another filler.

It should be appreciated from the above that in various different embodiments, the sections or parts thereof the elongated waveform have a constant amplitude, the sections of the elongated waveform have a varying amplitude, the sections of the elongated waveform have a constant amplitude, and/or the sections of the elongated waveform have a varying amplitude.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A joint edge insert comprising: an elongated waveform positionable between two spaced apart elongated joint edge members of a joint edge assembly attached to two adjacent concrete slabs and engagable with opposing respective first and second inner surfaces of the elongated joint edge members, the elongated waveform including an upstanding wall having a plurality of sections, the sections including a plurality of first member engagers extending in a first direction from a longitudinal central axis of the elongated waveform and engagable with the first inner surface of the first joint edge member of the joint edge assembly, and a plurality of second member engagers extending in an opposite second direction from the longitudinal central axis of the elongated waveform and engageable with the second inner surface of the second joint edge member of the joint edge assembly, wherein the elongated waveform is rigid in a vertical direction, is partially flexible in a longitudinal direction, is partially flexible in the transverse direction, and includes weakened areas that facilitate transverse compression of the elongated waveform.

2. The joint edge insert of claim 1, wherein a surface of the upstanding wall of the elongated waveform and an offset longitudinal central axis of the elongated waveform define a plurality of filler material receipt pockets.

3. The joint edge insert of claim 1, wherein the sections of the elongated waveform have a same radius of curvature.

4. The joint edge insert of claim 3, wherein the sections of the elongated waveform have a constant amplitude.

5. The joint edge insert of claim 1, wherein first outermost surfaces of all of the first member engagers extend in a same first vertical plane and second outermost surfaces of all of the second member engagers extend in a same second vertical plane spaced apart from the first vertical plane.

6. The joint edge insert of claim 1, wherein the sections of the elongated waveform have a constant amplitude.

7. The joint edge insert of claim 1, which is formed from steel.

8. The joint edge insert of claim 1, wherein the weakened areas include vertically extending notches defined by the sections of the elongated waveform.

* * * * *